United States Patent [19]

Michelson

[11] 4,204,569

[45] May 27, 1980

[54] MULTI-CORE BOX APPARATUS FOR THE MANUFACTURE OF HOLLOW MINERAL PRODUCTS, PARTICULARLY FOUNDRY CORES

[76] Inventor: Anatol Michelson, 3235 Pine Valley Dr., Sarasota, Fla. 33579

[21] Appl. No.: 974,102

[22] Filed: Dec. 28, 1978

[51] Int. Cl.[2] ..... B22C 11/06; B22C 15/24

[52] U.S. Cl. ..... 164/166; 164/16; 164/201

[58] Field of Search ..... 164/16, 37, 38, 165, 164/166, 200, 201, 202

[56] References Cited

U.S. PATENT DOCUMENTS

| | | | |
|---|---|---|---|
| 2,830,337 | 4/1958 | Shelby et al. | 164/165 |
| 2,852,818 | 9/1958 | Shallenberger et al. | 164/200 X |

FOREIGN PATENT DOCUMENTS

| | | | |
|---|---|---|---|
| 1016905 | 10/1957 | Fed. Rep. of Germany | 164/16 |

*Primary Examiner*—Robert D. Baldwin

*Attorney, Agent, or Firm*—Hauke and Patalidis

[57] ABSTRACT

Multi-core box apparatus for producing hollow foundry cores made from sand mixed with a binder that is curable either by gaseous catalytic action or by elevated temperature comprises a plurality of core boxes mounted on a housing that is rotatable in a vertical plane. The core boxes are presented sequentially by an index mechanism at various positions where treatment of material in the core boxes is carried out and at a last position a finished hollow foundry core is removed automatically from a core box.

The automatic apparatus for removing the finished core from the core box, and for depositing the finished core on a conveyor comprises an elongated rod that can be inserted into the hollow core and that supports the core when the core box half portions separate. The elongated rod is carried by a spindle on a movable carriage so that the spindle and rod rotate and reciprocate thereby removing the hollow core for further treatment.

19 Claims, 7 Drawing Figures

FIG. 1
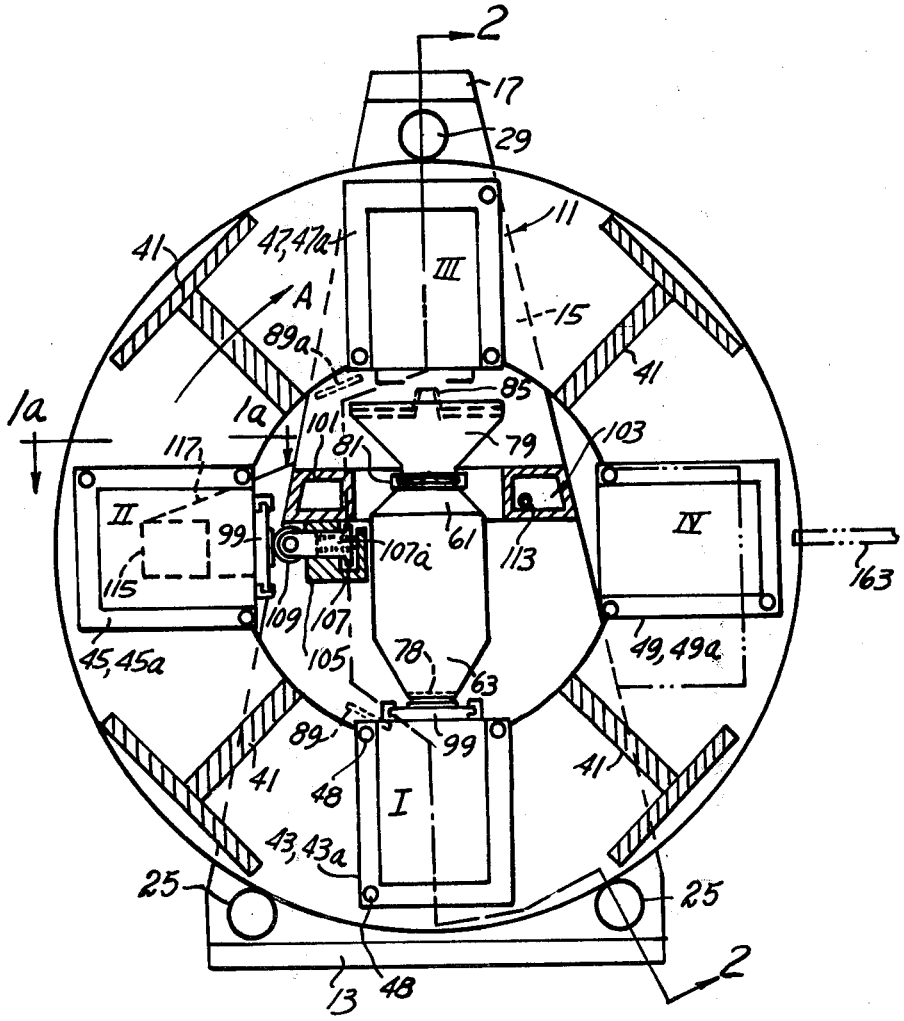
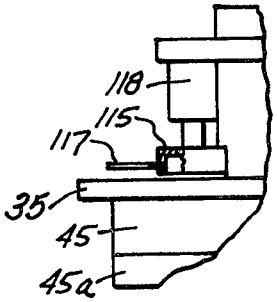
FIG. 1a

B
6
6

MULTI-CORE BOX APPARATUS FOR THE MANUFACTURE OF HOLLOW MINERAL PRODUCTS, PARTICULARLY FOUNDRY CORES

BACKGROUND OF THE INVENTION

The present invention relates to a multi-core box apparatus for making hollow mineral products, particularly foundry shell cores, using either the novel, heatless process described and claimed in my prior application, Ser. No. 939,660 filed Sept. 5, 1978, now abandoned, to which further reference may be made, or the well-known thermal or Croning process.

Since the heatless process, as of the present time, is quite new and, therefore, is not implemented in the foundry industry, there are no specialized types of equipment known at the present time, except an experimental unit, which, in essence, is a modified adaptation of existing apparatus, for carrying into practice the Croning process. All of the existing apparatus have at least five fundamental disadvantages, namely: low productivity rate resulting from performance of all operations in sequence within one single core box; the necessity for a turntable cradle on which the core box is mounted; the necessity for a sand return system from a hopper under the core box to a hopper over the core box, which system is particularly bulky and costly; the area around the core box is congested and is not readily accessible since all of the machine parts participating in the execution of the process directly have to be concentrated around that one, single core box; and the new heatless process cannot be carried into practice.

In contrast to the apparatus of the prior art, the apparatus of the present invention: is free from these disadvantages; has a significantly higher productivity rate; requires no cradle; need no sand return system; has easy access to the core boxes with simple, convenient design of tooling; and is suitable for both the old thermal Croning process and the new heatless process.

BRIEF SUMMARY OF THE INVENTION

A vertical frame supports rotatable housing including spaced apart annular plates to which are secured a plurality of core boxes; preferably four boxes being located at 90° spacings. Centrally located with respect to the rotatable annular plates are, among other things: a sand mixture supply hopper; a sand blower; and conduit for treating the sand mixture to harden and form a hollow core in the core box.

An automatic hollow core unloading machine is provided to remove from the core box the finished hollow core and to transfer it to another location.

For a further understanding of the invention and for features and advantages thereof, reference may be made to the following description and the drawings which illustrates one embodiment of apparatus in accordance with the present invention.

BRIEF DESCRIPTION OF THE DRAWINGS

In the drawings:

FIG. 1 is a schematic elevational view of apparatus in accordance with invention;

FIG. 1*a* is a top elevational view of a portion of FIG. 1 taken along line 1*a*—1*a* and at an enlarged scale;

DETAILED DESCRIPTION

Figure 2:
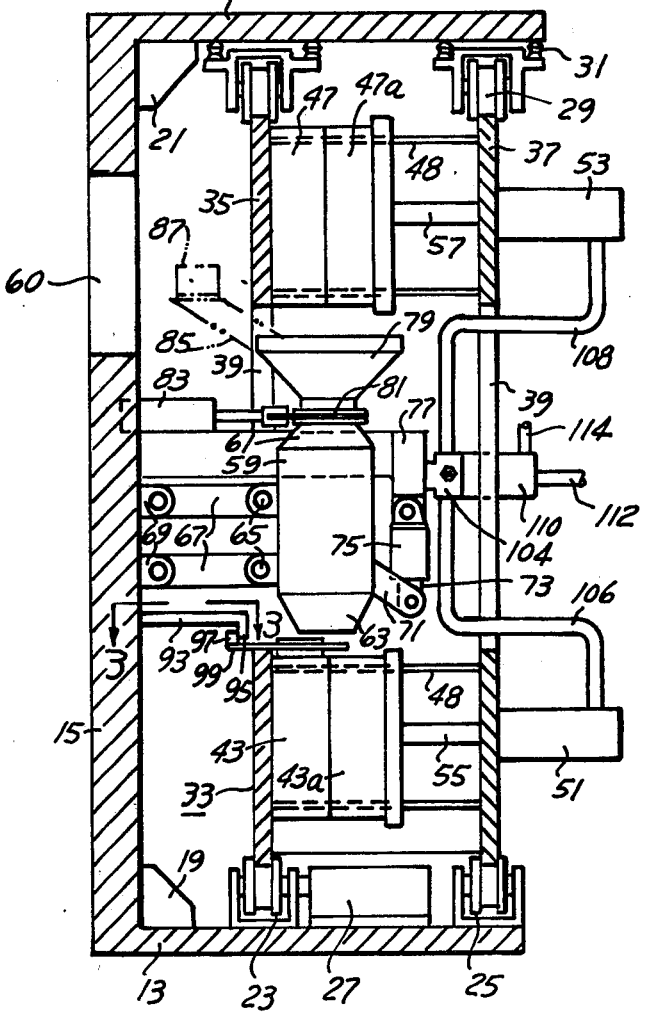
FIG. 2 is a partly schematic partly cross-sectional view substantially along line 2—2 of FIG. 1.

Referring to FIG. 1, a heavy frame 11 comprises a base portion 13, a triangular-shaped vertical portion 15, and a horizontal top portion 17. A suitable bracket 19 is secured, as by welding, to the base portion 13 and the vertical portion 15. A similar bracket 21 is secured to the top portion 17 and the vertical portion 15.

On the base portion 13 there are located, about where shown, spaced-apart pairs of rollers 23, 25 and one pair of such rollers 23 is power driven by a conventional motor-speed reducer, or by a hydraulic motor 27.

The top portion 17 also carries one pair of rollers 29 that are mounted thereto by means of conventional resilient devices 31, such as Belleville springs, or the like.

The bottom pairs of rollers 23, 25 and the top pair of rollers 29 carry and rotatably support a housing 33 comprising two spaced-apart annular plates 35, 37, each annular plate having a large central opening 39.

The annular plates 35, 37 are rigidly inter-connected by means of T-bars 41, spaced suitably about as shown.

Internally of the housing 33, there are mounted to the annular plates 35, 37 four core boxes, each comprised of two half portions 43, 43*a*; 45, 45*a*; 47, 47*a*; and 49, 49*a*. The core boxes are arranged 90° apart, as shown in FIG. 1. The half core box portions 43, 45, 47, 49 are rigidly mounted to the annular plate 35, and the other half core box portions 43*a*, 45*a*, 47*a*, 49*a* are slidably mounted on three rods 48 that extend between, and are rigidly connected to, the annular plates 35, 37.

Externally of the housing 33 there are mounted to the annular plate 37, in corresponding relation to each one of the half core box portions 43*a*, 45*a*, 47*a*, 49*a*, fluid-acting, cylinder-piston assemblies; however, only two such cylinder-piston assemblies 51, 53 are shown in FIG. 2. Each cylinder-piston assembly 51, 53 has a piston rod, such as rods 55, 57, extending through the annular plate 37 and connected to the half core box portions 43*a*, 45*a*, 47*a*, 49*a*. The core boxes mentioned herein are either like those shown, described and claimed in my prior application mentioned previously herein, or like those commonly used at the present time.

Between the annular plates 35, 37 there is mounted a blow head 59 having a frusto-conical top 61 and a frusto-conical bottom 63. The blow head 59 is pivotally mounted, as at 65, to a pair of links 67 pivotally connected to brackets 69 secured to the vertical wall portion 15 which has one or more access openings 60. The blow head 59 is also provided with an arm 71 that connects pivotally to a piston rod 73 of the cylinder-piston assembly 75; the cylinder-piston assembly 75 being mounted pivotally to fixed support structure 77 connected to the wall 15. The lower end of the frusto-conical bottom portion 63 carries a transverse blow-plate 78 in which there are a plurality of small holes (not shown) having diameters of about one-half inch.

Above the blow head top portion 61 there is a hopper 79 having a slidable gate 81 that controls the flow of sand mixture from the hopper 79 into the blow head 59. The gate 81 is actuated by a cylinder-piston assembly 83 supported by the vertical wall portion 15.

Associated with the hopper 79 is a chute 85 that is disposed beneath the output end 87 of a conventional continuous mixer (not shown).

Figure 3:
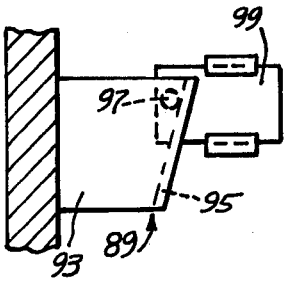
FIG. 3 is a view along line 3—3 of FIG. 2.

FIG. 3 illustrates schematically a pair of cams for covering an aperture in the core boxes shown and described in my prior application. One cam 89 is called a closing cam and includes a slightly arcuate plate 93 having a flange 95. The plate 93 is fixed to the vertical wall portion 15 about where shown in FIG. 1. A pin 97, protruding above the top of a slidable gate 99, engages the flange 95 and thereby closes the aperture as the housing 35 rotates in the direction of the arrow A. As shown in FIG. 1, there is another cam 89*a* which is similar to opposite hand and is an opening cam.

Extending between the annular plates 35, 37, about where shown in FIG. 1, are two hollow beams 101, 103 which are the side portions of a U-shaped yoke. As shown in FIG. 1, the beam 101 supports a hollow guide 105 in which is disposed a slidable plunger 107, resiliently activated by a spring 107*a*. The plunger 107 carries at one end a roller 109 that coacts with the gate 99. The hollow beam 103 carries internally fluid conduits 113 that convey gaseous fuel to conventional shell core box whenever the present apparatus is used to carry out the Croning process.

Associated with the yoke arms 101, 103 is first a hydraulic rotary joint 104 which connects to conduits 106, 108 carrying hydraulic fluid to the cylinder-piston assemblies 51, 53 respectively.

Whenever the present apparatus is used to carry out the Croning process, another rotary joint 110 of conventional design is mounted adjacent the rotary joint 104 and a fuel gas conduit 112 connects to the rotary joint 110, as suggested in FIG. 2.

As shown in FIG. 1*a* the core box 45, 45*a* cooperates with an inlet portion 115 of conduit 117 carrying a catalytic gas to the core box, as shown and described in my prior application. A cylinder-piston assembly 118 is used to press the inlet portion 115 sealingly over the aperture in the core box.

The portion 115 is connected through a conventional three-way valve to a supply of catalyst gas, to an exhaust system, and to a supply of compressed air.

As is well known by those skilled in the foundry art, the removal of cores from a core making machine carrying out the Croning process is a tedious task carried out in an uncomfortable environment. The cores are formed by heat and, when removed, they are very hot and personnel operating the core machines work under difficult conditions.

Recognizing this disadvantage of existing core making apparatus, the present invention includes an automatic apparatus for removing hollow shell cores from the apparatus of the invention shown in FIGS. 1–3 described previously herein.

Figures 4, 5, 6:
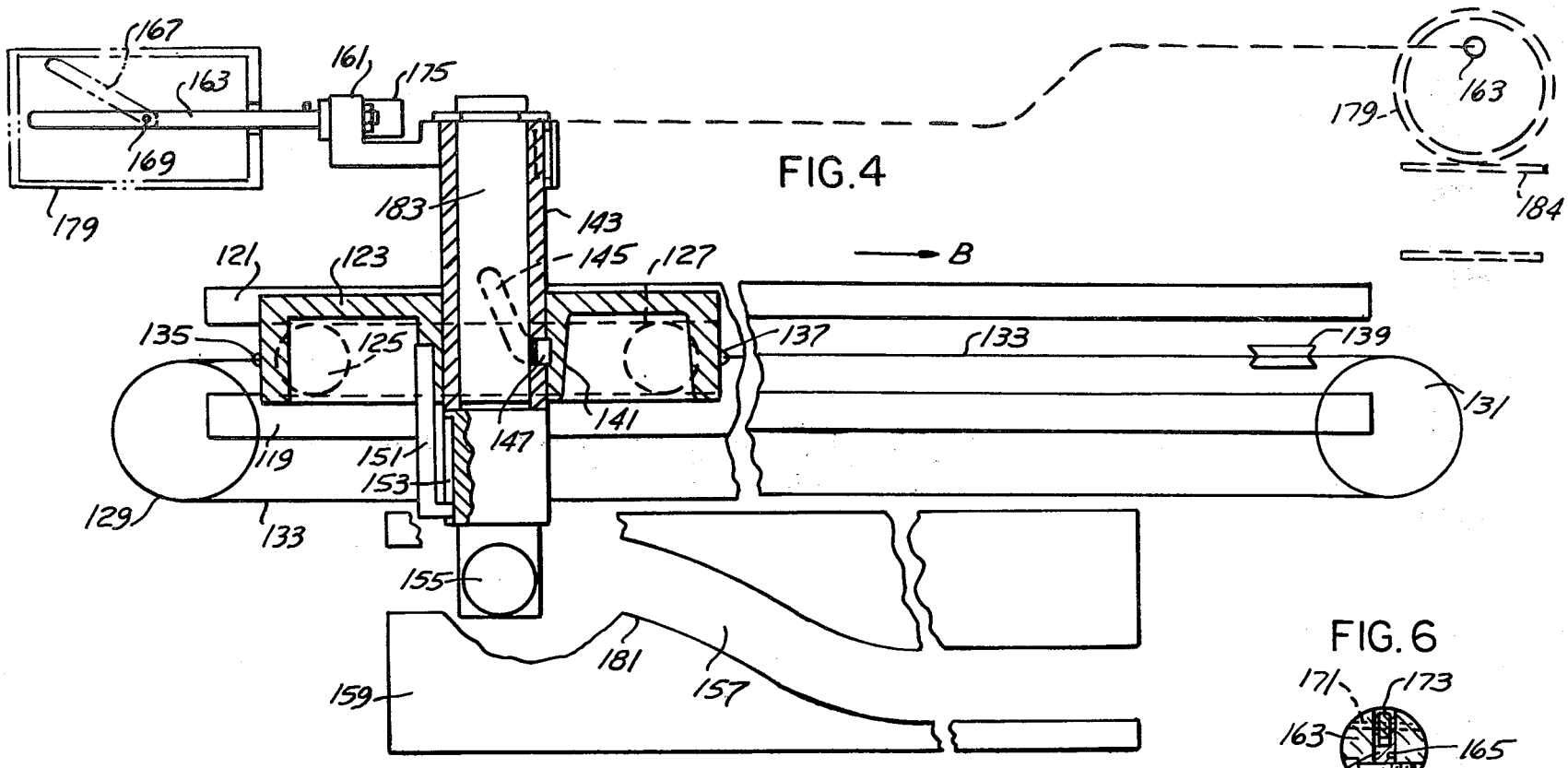
FIG. 4 is an elevational view of a core unloading apparatus in accordance with the invention.
FIG. 5 is a view of a portion of the apparatus of FIG. 4 at an enlarged scale.
FIG. 6 is a view along line 6—6 of FIG. 5.

FIG. 4 is an elevational view of one embodiment of such a core removal apparatus. It comprises: spaced-apart, vertically arranged, pairs of elongate rails 119, 121 supported in a conventional manner (not shown); a carriage 123 having pairs of rollers 125, 127 that coact with the lower rails 119; a pair of stationary sheaves 129, 131 that coact with a wire rope or chain 133 anchored, as at 135, to the left hand end of the carriage 123, and, as at 137, to the right-hand end of the carriage 134. One of the sheaves 131 say, is powered preferably by a hydraulic motor (not shown) of conventional kind, but any other suitable power source may be used if preferred. Near sheave 131 is a guidance sheave 139 that coacts with the wire rope 133.

As shown in FIG. 4, the carriage 134 supports in a boss 141 a rotatable and reciprocable sleeve 143 surrounding an axle 183. In the outer surface of the axle 183 is a helical cam groove 145 that receives a cam follower 147. Mounted to the side of the boss 141, about where shown, is an L-shaped stop 151 that coacts with a groove 153 in the outer surface of the sleeve 143.

The lower end portion of the axle 183 supports a roller 155 contacting a cam groove 157 in a base member 159.

The upper end of the sleeve 143 carries a bracket 161 to which is secured, about as shown, an elongate rod 163, that may, in some cases, be straight, or it may be an L-shaped rod.

Referring to FIGS. 5 and 6, the straight or L-shaped rod 163 has a circular cross-section, and the outer end portion is grooved, as at 165, to accommodate an elongate bar 167 having a rectangular cross-section. The elongate bar 67 is pivotally mounted, as at 169, to the bar 163 and is also pivotally connected, as at 171, to an actuator rod 173. The actuator rod 173 is an extension of a piston encased in a fluid-actuated cylinder 175 of conventional form. Instead of the fluid-actuated cylinder 175, an electrical solenoid actuator may be used if preferred.

At the outer end of the elongate rod 163 is a triangular rest or stop 177 for the elongate bar 167 when in the inoperative position. The position of the rod 167, shown in FIGS. 4 and 5, is the operative position.

When the housing 33 has rotated through 270°, to bring the core box 43 from position I to position IV, the core box half-portion 49*a*, which is slidable on the rods 48, under the influence of the hydraulic cylinder-piston assembly 51, starts to move away from the fixed core box half-portion 49. At this instant, ejection pins in the half-portion 49, acting under the effect of springs compressed by the movable core box half-portion 49*a*, urge the core out of the fixed half-portion 49. At first, the half-portion 49*a* moves a distance of one-half its stroke, at which time the rod 163 is inserted into the investment hole in the shell core. Thereafter, the movable core box half-portion 49*a* starts to move to the end of its stroke, and the core ejection pins of this core box half-portion urge the core out it. Simultaneously, the fluid actuated cylinder-piston assembly 175 is activated to move the actuator rod 173 toward the right, as viewed in FIG. 5, and the bar 167 pivots to the angular position shown in FIG. 5. The bar 167 contacts the inner surface of the hollow core and it is supported thereby as the core box moves away from it.

After the hollow shell core is removed from the core box, the movable half-portion 49*a* of the core box again mates with the fixed half-portion 49, as the housing rotates 90° and presents the core box again at position I, the initial position, to commence another cycle.

The carriage 123, under the influence of the powered sheave 131 and the wire rope 133, travels any convenient distance toward the right, as viewed in FIG. 4. When the carriage reaches a point 181 where the contour of the cam groove 157 turns downward, the sleeve 143 both reciprocates down and rotates through 90° under the influence of the cam groove 157 and the cam cam-follower 145, 147 respectively. The rotary and downward motion of the sleeve and the rod 163 carrying the shell core 179 present the shell core at a location, suggested by the dotted outline in FIG. 4, where it is deposited onto a conveyor belt 184 which carries the core 179 away from the rod 163.

After the shell core has been removed from the rod 163, the carriage returns to its initial position at which it commences another cycle.

In use, the blow head 59 receives from the hopper 79 a supply of sand coated with a liquid binder that is hardenable either by a catalytic gas or by heat.

Let us first consider only the new heatless process wherein the hardening of the sand mixture is accomplished by a catalist gas.

The core box at position I, is ready to receive the granular mixture, and so, the blow head is lowered under the influence of the cylinder-piston 75 until it contacts and seats sealingly with the aperture in the core box. Thereupon, the granular mixture is blown by air into the core box, and the pattern therein fills with the mixture.

As soon as the pattern is filled the air pressure in the blow head is reduced to atmospheric pressure and the housing rotates in the direction of arrow A. As the housing rotates, the pin 97 on the slidable gate 99 engages the flange of the closing cam 89 and the slidable gate 99 closes the aperture in the core box.

When the core box reaches position II, the roller 109 contacts the slidable gate 99 and, under the urging of the resilient member 107*a* contacting the plunger 107, the slidable gate sealingly closes the aperture. At this time, the catalytic gas, described in my prior application, enters the core box through the conduit 117 and reacts to harden the outer layer of the mixture within the porous pattern inside the core box, thus forming a hollow shell core with a quantity of mixture inside of it that was not hardened.

The housing, acting under the influence of conventional indexing apparatus, not shown, advances the formed shell core from position II to position III. Just prior to reaching position III however, the pin 97 of the slidable gate 99 engages the opening cam 89*a*, and the slidable gate 99 opens. The loose, unhardened granular mixture inside the pattern now gravitates therefrom into the hopper 79 from which it flows into the blow head for use again. Those skilled in the art will recognize that in some instances, a vibrator or the like may be used to loosen the granular unhardened mixture so that it can flow freely from the pattern at position III.

After a predetermined number of seconds of time, the housing indexes another 90° rotation and advances the core box from position III to position IV. At position IV the finished hollow core is removed from the core box as described previously herein, or it may be removed manually.

When the present apparatus of the invention is used for performing the thermal or Croning process to produce shell cores, then on both sides of each core box half-portions are placed conventional gas burners in the manner described and shown in the prior art. Fuel gas to these burners is supplied through inlet 112 and conventional rotary joint 110. The burners keep the core box half portions at approximately 450° F., which is sufficient to harden the binder in the outer layer of sand inside the core box.

The productivity rate of the apparatus of the invention is determined by the ratio, $P=60/C$, where P is productivity in the number of products made in one hour and C is the duration of the production cycle in minutes. $C=T+t$, where T is the dwelling time of the housing 33 and is equal to the duration of the longest operation performed at any one position during the cycle; and t is the indexing time of the housing 33 and is equal to the time required to turn the housing 33 through an angle 360°/n, where n is the number of positions or core boxes on the housing 33.

When the apparatus of the invention is used to perform the heatless process, T, on the average, is 6 seconds; t is 2 seconds; and therefore C is 8 seconds.

Apparatus known from the prior art, when used to perform the Croning or heat process, consumes, on the average, 3 minutes or 180 seconds to complete a cycle. Thus, for prior art apparatus the productivity rate, $C_1$, is 180 seconds. Hence, the productivity rate of the apparatus of the invention is $C_1/C$ or $180/8=22.5$ times the productivity rate of apparatus known from the prior art.

From the foregoing description of one embodiment of the invention, those skilled in the art will recognize many important features and advantages of it, among which the following are particularly significant:

That the apparatus of the present invention is used to produce hollow mineral products by either the heatless forming process of my prior invention or by conventional thermal-forming or Croning process;

That the apparatus produces hollow mineral products at a much higher productivity rate of speed than conventional apparatus using the conventional thermal process;

That a conventional sand recirculating system, used by conventional apparatus, is not required for the apparatus of the present invention;

That conventional core box cradles, required by conventional apparatus, are not needed in the apparatus of the present invention;

That the hollow product removal and transferring apparatus of the present invention eliminates the need for intensive manual labor during operation of conventional shell core forming apparatus, and makes full automation of the heatless process possible;

That the present apparatus includes a plurality of core boxes in which hollow mineral products are formed in a sequence of steps, and the core boxes rotate in a vertical plane about a horizontal axis; and That the apparatus includes an automatic device that supports and removes the finished hollow mineral products from an open core box and transports such product to another location, using no manual assistance.

While the invention has been described herein with a certain degree of particularity it is to be understood that the present disclosure is made only as an example of the invention and that the scope of the invention is defined by what is hereafter claimed.

What is claimed is:

1. Apparatus for producing hollow mineral products from a mixture of sand and a binder hardenable when contacted by a catalytic gaseous fluid comprising:

a. a support frame;

b. a housing supported by said frame and rotatable in a vertical plane;

c. means for rotating said housing;

d. a plurality of product forming units mounted to said housing and rotatable therewith;

e. a sand blower mounted centrally of said housing in such a way that said product forming units rotate around said sand blower, said sand blower including a perforated blow plate;

f. means for reciprocating said sand blower relative to a product forming unit therebeneath, thereby bringing said blow plate into engagement with said product forming unit and over an aperture therein;

g. a hopper for receiving and holding a quantity of said mixture of sand and binder disposed above said sand blower whereby said mixture gravitates from said hopper into said sand blower; and h. means for urging said mixture through said blow plate into said product forming unit beneath said sand blower.

2. The invention of claim 1 including:

a. means for opening and closing said aperture of each product forming unit as said housing rotates.

3. The invention of claim 2 wherein:

a. said product forming units are core boxes; and b. said means comprises slidable members on each core box, stationary cams, and a cam follower on each said core box that coacts with said stationary cams.

4. The invention of claim 3 including:

a. a roller under elastic force coacting with the slidable member of each core box.

5. The invention of claim 1 wherein:

a. said housing includes spaced apart interconnected annular plates supported peripherally by at least three pairs of rollers;

b. said core boxes are mounted to said annular plates; and wherein c. one pair of said rollers is under elastic force urging said annular plates against the other two pairs of rollers.

6. The invention of claim 3 wherein:

a. each core box contains a pattern, and said core box is adapted to be indexed to a plurality of positions at one of which means are disposed for introducing catalytic gaseous fluid into said core box to react with a portion of said mixture in said pattern, whereby it hardens and forms a hollow mineral product.

7. The invention of claim 6 wherein:

a. said hopper is mounted below a second position subsequent to said one position, such that the unhardened portion of said mixture is adapted to gravitate from said pattern into said hopper.

8. The invention of claim 1 including:

a. means for supplying gaseous fuel to said apparatus for heating said product forming units and forming products in said units.

9. The invention of claim 7 wherein:

a. at a third position, subsequent to said second position, means are provided to move a movable portion of said core box relative to a fixed portion.

10. The invention of claim 1 including:

a. first means for supporting and removing said formed product from said core box; and b. second means for activating said first means whereby said first means and said product move sequentially around a vertical axis and reciprocally parallel to said axis.

11. The invention of claim 10 wherein:

a. said first means includes, i. an elongate rod inserted into an investment hole in said hollow mineral product, and ii. means for supporting said product on said rod.

12. The invention of claim 10 wherein said second means includes:

a. a carriage carrying a reciprocable and rotatable sleeve;

b. an axle surrounded by said sleeve and immovable relative to said sleeve;

c. means mounting said rod on said sleeve;

d. means for moving said carriage toward and away from said core box; and e. cam and cam follower means for both reciprocating and rotating said sleeve.

13. The invention of claim 11 wherein said means for supporting said product on said rod includes:

a. a support link pivotally mounted to said rod; and b. means for pivoting said support link so as to engage the inner surface of said hollow mineral product when said rod is inserted therein.

14. The invention of claim 12 wherein said cam and cam follower means includes:

a. a first cam groove in the outer surface of said axle;

b. a first cam follower in said sleeve coacting with said first cam groove;

c. a second cam disposed relative to said sleeve; and d. a second cam follower on said sleeve coacting with said second cam whereby, when said carriage moves relative to said core box, said sleeve both rotates about a vertical axis and reciprocates vertically.

15. The invention of claim 11 wherein:

a. said rod has an L-shape.

16. The invention of claim 10 wherein:

a. said means for supporting and removing said formed product is enclosed.

17. The invention of claim 12 wherein:

a. said carriage moves horizontally relative to said core box.

18. The invention of claim 11 wherein:

a. said rod is inserted into said investment hole when said movable portion of said core box has moved partially relative to said fixed portion of said core box.

19. The invention of claim 12 wherein said means for moving said carriage includes:

a. a flexible elongate member; and b. power means engaging said flexible member.

* * * * *